US006520892B1

(12) United States Patent
Hassler

(10) Patent No.: US 6,520,892 B1
(45) Date of Patent: Feb. 18, 2003

(54) THERAPY AND TRAINING DEVICE

(76) Inventor: Andreas Hassler, Ranhartstetten 10, DE-83101 Rohrdorf (DE)

( * ) Notice: Subject to any disclaimer, the term of this patent is extended or adjusted under 35 U.S.C. 154(b) by 0 days.

(21) Appl. No.: 09/402,602

(22) PCT Filed: Apr. 22, 1998

(86) PCT No.: PCT/DE98/01125

§ 371 (c)(1),
(2), (4) Date: Oct. 22, 1999

(87) PCT Pub. No.: WO98/47461

PCT Pub. Date: Oct. 29, 1998

(30) Foreign Application Priority Data

Apr. 23, 1997 (DE) ..... 197 16 942

(51) Int. Cl.[7] ..... A63B 69/16; A63B 22/06
(52) U.S. Cl. ..... 482/57; 482/60; 482/63
(58) Field of Search ..... 482/57, 60, 904, 482/63, 64, 65, 119

(56) References Cited

U.S. PATENT DOCUMENTS 4,570,927 A * 2/1986 Petrofsky et al.
5,472,396 A * 12/1995 Brazaitis
5,833,583 A * 11/1998 Chuang
6,447,428 B1 * 9/2002 McKillip

* cited by examiner

*Primary Examiner*—Jerome W. Donnelly
(74) *Attorney, Agent, or Firm*—McGlew and Tuttle, P.C.

(57) ABSTRACT

Therapy and exercise unit (10) for restricted-guidance knee joint motion, having two lower leg receivers (35, 36), which are disposed on a guiding arrangement (11) and connected by articulated devices (23, 24) to a transmission element (28) of the guiding arrangement, which transmission element connects the lower leg receivers to one another in a motionally coupled manner such that a swivelling motion of the one lower leg as a result of bending of the knee initiates an oppositely directed swivelling motion of the other lower leg, wherein, for connection of the lower leg receivers (35, 36) to the articulated devices (23, 24), a lever (34) is provided which produces a restoring moment (Gxh), which in terms of the direction of rotation counteracts a leg extension, about a pivot (45) of the respective articulated device (23, 24).

17 Claims, 2 Drawing Sheets

THERAPY AND TRAINING DEVICE

Figure 1:
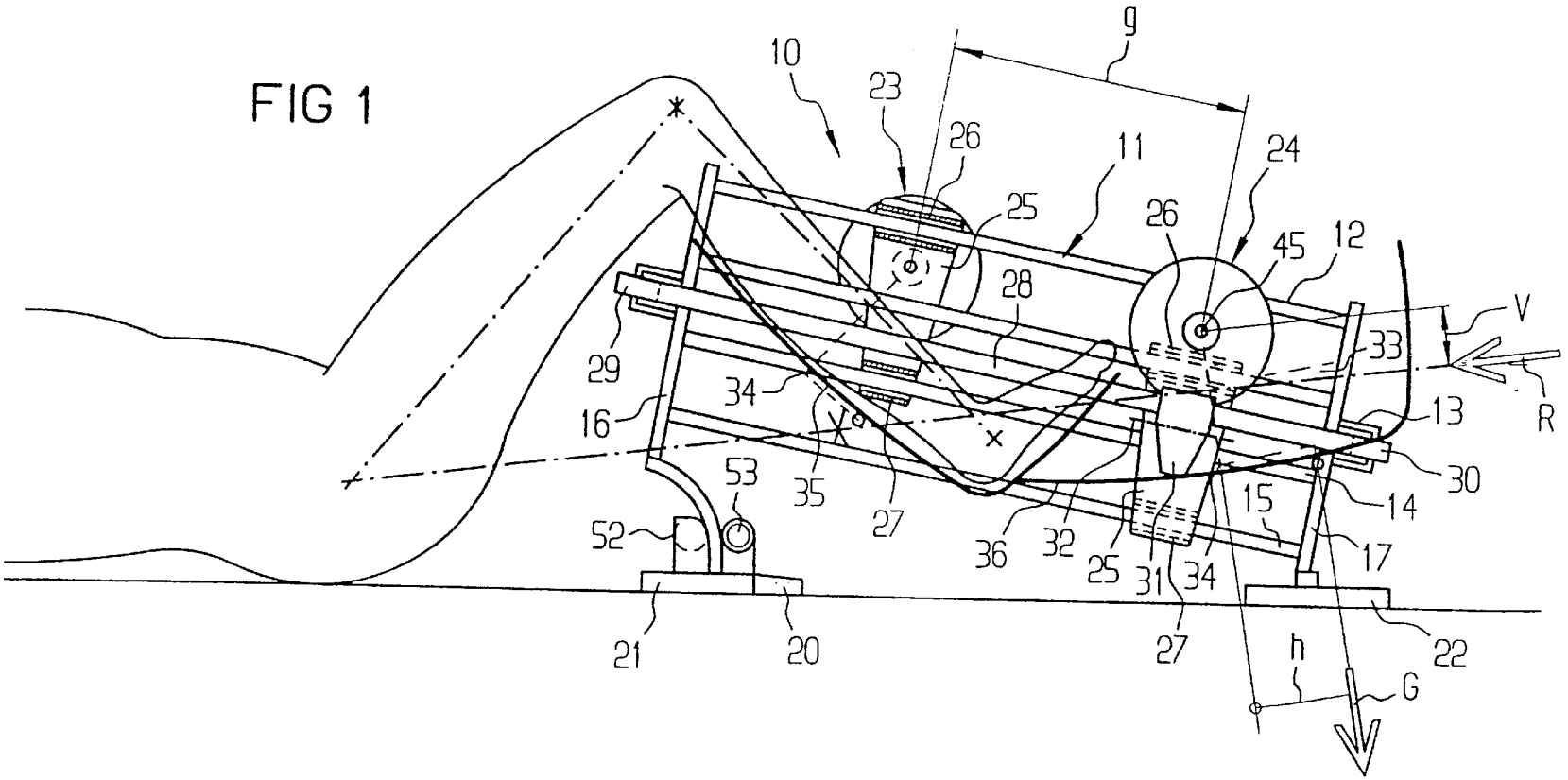

The present invention relates to a therapy and exercise unit for restricted-guidance knee joint motion, having two lower leg receivers, which are disposed on a guiding arrangement and connected by articulated devices to a transmission element of the guiding arrangement, which transmission element connects the lower leg receivers to one another in a motionally coupled manner such that a swivelling motion of the one lower leg as a result of bending of the knee initiates an oppositely directed swivelling motion of the other lower leg.

From WO 96/29040 a therapy and exercise unit of the type described initially is known, which has as a transmission element a cable, to which are connected the articulated devices which via articulated levers establish a connection with the lower leg receivers. The articulated devices connected in a motionally coupled manner to one another by the cable are guided in a horizontally disposed guiding arrangement, which takes the form of a guide rail and is disposed on the ground or on the subsurface, on which the patient having therapy is situated. Thus, the lower leg receivers in the known therapy and exercise unit are situated during operation above the articulated devices.

During operation of the known therapy and exercise unit, in individual cases it has proved difficult for the patient having therapy to move the extended leg out of the extended position.

The object of the present invention is therefore to propose a therapy and exercise unit of the type described initially, which makes it easier for the patient to move the extended leg out of the extended position in order to continue the motion therapy.

Said object is achieved by a therapy and exercise unit having the features of claim 1, claim 3 or claim 5.

In the solution according to claim 1, for connection of the lower leg receivers to the articulated devices, a lever is provided which produces a restoring moment, which in terms of the direction of rotation counteracts a leg extension, about a pivot of the respective articulated device.

The manner according to the invention in which the lower leg receivers are coupled to the articulated device ensures that, instead of the entire weight of the extended leg acting in a manner which stabilizes the extended position, at least part of the lower leg accommodated in the lower leg receiver causes in relation to the pivot of the articulated device a moment counteracting said stabilizing position. Lifting of the leg, in order at the start of flexion of the leg to move at least slightly out of the extended position, is therefore made far easier for the patient.

When the lever is designed so as to be variable in its effective length, a variation during the movement or alternatively an adaptation to the lever ratios of the legs of the patient may be effected.

According to a further solution according to the invention, the articulated devices are disposed on the guiding arrangement in such a way that the articulated device, which via the relevant lower leg receiver is associated with the flexed leg, is in a higher position than the articulated device, which via the relevant lower leg receiver is associated with the extended leg.

The energy potential of the flexed leg, which is greater than that of the extended leg, may therefore be utilized to enable the patient to move the extended leg out of the extended position.

An advantageous embodiment of said solution according to the invention consists of designing the guiding arrangement in such a way that it comprises an inclined guideway for the articulated devices.

According to a further solution according to the invention, the lower leg receivers are disposed on the articulated devices in such a way that the axis of force of the extended leg is situated below a pivot of the articulated devices.

It is thereby ensured that, during the transfer of the flexed leg from its end position into the extended position, a force is transmitted via the transmission element to the leg situated in the extended position, with the result that a restoring moment, which in terms of its direction of rotation counteracts the extension movement of said leg, arises about the pivot of the articulated device. Said measure also makes it easily possible for the patient to surmount the dead centre of motion in the therapy and exercise unit which arises when a leg is in the extended position.

The previously described, independent solutions to the problem, on which the invention is based, may also be combined in any desired manner with one another in order to enhance even more the effect, already achieved by each individual solution, of noticeably improved surmounting of the dead centre of the motion effected in the therapy and exercise unit.

There now follows a detailed description of preferred embodiments of the independent solutions according to claims 1, 3 and 5.

Thus, in each of the solutions according to the invention, it proves advantageous when the articulated devices are variable in terms of their arrangement relative to the transmission element. It is therefore possible, for example, to vary the range of linear motion along the guideway without having to vary the position of the therapy and exercise unit relative to the patient.

Furthermore, in all of the solutions according to the invention, it proves advantageous when the articulated devices are provided with a swivel radius limiting device so that the radian measure of the desired range of motion may be fixed exactly.

An improvement in the practical handling of the therapy and exercise unit may be achieved in each solution when the lower leg receivers are releasably connected to the articulated devices by a snap-in connection.

It is therefore possible, for example, to effect the positioning of the therapy and exercise unit next to the patient without the projecting lower leg receivers and hence make the positioning more comfortable for the patient.

A particularly advantageous construction of the snap-in connection is achieved when there is provided on the lower leg receivers a connecting pivot pin in the form of a snap-in pin, which is intended for engagement into a swivel eye of the articulated device.

Figure 2:
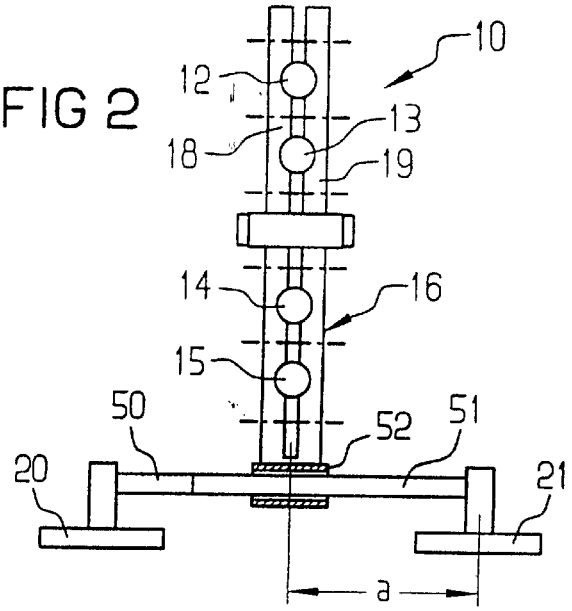
Figure 3:
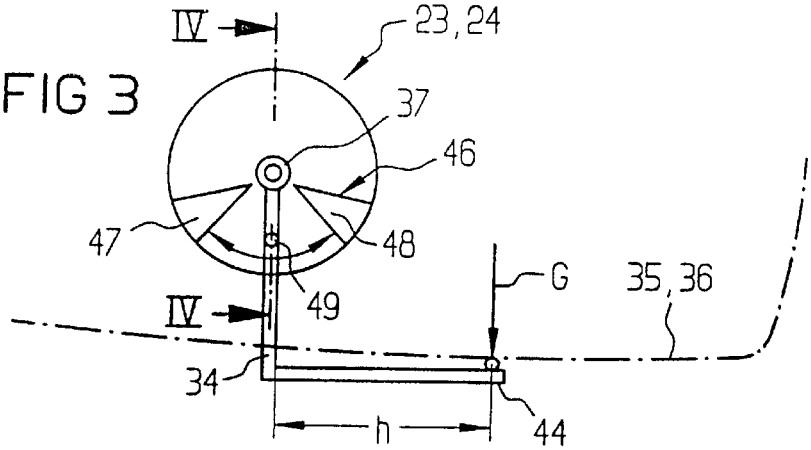
Figure 4:
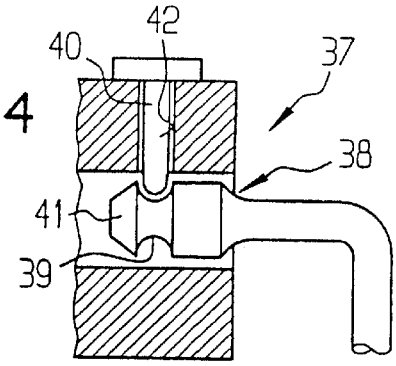

There now follows a detailed description of a preferred embodiment of the therapy and exercise unit with reference to the drawings. The drawings show:

FIG. 1 a side view of a therapy and exercise unit;

FIG. 2 a front view of the therapy and exercise unit illustrated in FIG. 1;

FIG. 3 a detailed view of an articulated device of the therapy and exercise unit;

FIG. 4 a sectional view of the articulated device illustrated in FIG. 3 according to the cutting line IV—IV in FIG. 3.

FIG. 1 shows a therapy and exercise unit 10 in use by a patient. In the embodiment illustrated in FIG. 1, the therapy and exercise unit 10 has a guideway arrangement 11 comprising four guide rods 12, 13, 14, 15, which at their ends are combined by means of post parts 16, 17, which each comprise two clamping halves 18, 19 (see FIG. 2), to form the guideway arrangement 11. Situated at the bottom ends of the post parts 16, 17 are feet 20, 21 and 22 which enable the therapy and exercise unit 10 to be set up between the legs of a patient in the manner shown in FIG. 1.

Situated on either side of the guideway arrangement 11, i.e. on the side directed towards the viewer of FIG. 1 and on the side remote from the viewer of FIG. 1, is an articulated device 23, 24, which is connected to the guideway arrangement 11 by a guide part 25 arranged so as to be longitudinally displaceable along two guide rods 12, 14 and 13, 15 respectively. Each guide part 25 comprises two longitudinal guides 26, 27 which, on the one hand, enable reliable guidance along the guide rods 12, 14 and 13, 15 respectively and, on the other hand, prevent the articulated devices 23, 24 from swivelling laterally away from the guideway arrangement 11.

For the motional coupling between the articulated devices 23, 24 a transmission element, here in the form of a toothed belt 28, is provided, which is conveyed around the guideway arrangement 11 by means of two guide pulleys 29, 30 positioned laterally on the post parts 16, 17. The articulated devices 23, 24, for their connection to the toothed belt 28, have drivers 31 which are pivotally disposed on the articulated devices 23, 24 and receive the toothed belt 28 clamped positively between themselves and the guide part 25 of the articulated device 23, 24. In said case, the positive meshing of the drivers 31 with the toothed belt 28 is ensured by means of a pressure spring (not specifically shown here). For driver disengagement, the driver 31 may, with simultaneous surmounting of the spring force, be swivelled about a driver axis 32. In said disengaged position, it is possible infinitely to vary the distance g between the articulated devices 23, 24 or to displace the latter, while maintaining a desired distance g, both by the same amount in one or the other direction along the guideway arrangement 11.

To accommodate the lower legs 32, 33 of the patient, lower leg receivers 35, 36 are pivotally connected by lever arrangements 34 to the articulated devices 23, 24. In the view according to FIG. 1, the left lower leg 32—the outline contours of which are shown—of the patient is accommodated by the lower leg receiver 35 connected to the articulated device 23 in such a way that the left leg is in its flexed position. In comparison, the right lower leg of the patient, which is illustrated merely by the course of the associated lower leg axis 33, is situated in the lower leg receiver 36 associated with the articulated device 24 in such a way that the right leg of the patient is in its extended position.

Upon transfer of the left leg of the patient from its flexed position into its extended position, i.e. upon swivelling of the left lower leg relative to the associated upper leg, a longitudinal displacement of the articulated device 23 to the right is effected as a result of the transmission of force via the lower leg receiver 35 and the lever arrangement 34. To the same extent, an oppositely directed movement of the right leg of the patient from its extended position shown in FIG. 1 into the flexed position is effected as a result of the transmission of force via the toothed belt 28, the articulated device 24, the lever arrangement 34 and the lower leg receiver 36.

As is shown in FIG. 1 and is even more clearly evident from FIG. 3 and 4, the lever arrangement 34 is pivotally connected to the articulated device 23, 24 by a connecting pivot pin 38 inserted in a swivel eye 37 of the articulated device 23, 24. As FIG. 4 further reveals, the connecting pivot pin 38 has a circumferential detent groove 39, into which a spring-loaded locking pin 40 engages. To insert the connecting pivot pin 38 into the swivel eye 37 of the articulated device 23, 24, the connecting pivot pin 38 is pressed, with simultaneous surmounting of the spring resistance of the locking pin 40, into the swivel eye 37 until the locking pin 40 snaps into the detent groove 39. Said operation is assisted by a lead-in cone 41 formed on the end of the connecting pivot pin 38. To release the connecting pivot pin 38 from the swivel eye 37, the locking pin 40 is moved counter to the resistance of the spring (not specifically shown here) far enough out of its guide bore 42 to clear the detent groove 39 and enable removal of the connecting pivot pin 38 from the swivel eye 37.

As FIG. 3 shows, the lever arrangement 34 is bent at right angles so that a force due to weight G exerted by the lower leg receiver 35, 36 via a receiver connection 41 upon a lever end 44 of the lever arrangement 34 produces a weight moment, which corresponds to the force due to weight G multiplied by a right-angle bend lever h of the lever arrangement 34. For influencing the weight moment, the right-angle bend lever h may be designed so as to be variable.

As is clear from the transmission of said weight moment G.h in FIG. 1, said moment assists the movement of the, in FIG. 1, right leg of the patient out of its extended position, which coincides with an end-point or dead-centre position of the reciprocating motion of the articulated devices 23, 24 along the guideway arrangement 11.

As is further evident from FIG. 1, in the illustrated extended position of the right leg of the patient, the lower leg receiver 36 is connected by the lever arrangement 34 in such a way to the articulated device 24 that the lower leg axis 33 is situated offset downwards by an offset amount v relative to the pivot 45 of the articulated device 24. Acting together with the restoring force R, which as a result of an extension movement of the left leg of the patient is transmitted via the toothed belt 28 and the lower leg receiver 36 to the right leg of the patient or the lower leg axis 33 of the right lower leg, is a restoring moment R.v which—in a similar manner to the previously described weight moment G.h—assists the movement of the right leg of the patient out of its extended position.

By virtue of making v variable—e.g. through a suitable design of the lever arrangement 34—the magnitude of the restoring moment may be influenced.

It is moreover clear from FIG. 1 that, because of the inclined guideway arrangement 11, the articulated device 23 associated with the flexed leg is situated at a higher level than the articulated device 24 associated with the extended leg. It is therefore possible to utilize the force due to weight of the flexed leg to assist the movement of the extended leg out of its extended position.

As FIG. 3 reveals, the articulated device 23 or 24 has a swivel radius limiting device 46 comprising two angle stops 47, 48, which are variable in terms of their position relative to the articulated device 23, 24 and cooperate with a stop pin 49 on the lever arrangement 34 and hence limit the swivelling motion of the lever arrangement 34 relative to the articulated device 23, 24.

As FIG. 2 additionally reveals, in the present case the feet 20, 21 associated with the, in FIG. 1, left post part 16 are connected to the post part 16 by extendable rods 50, 51 in associated rod receivers 52, 53. It is therefore possible, where necessary, to remove the feet 20, 21 completely from the post part 16 or to select the positioning of the feet relative to the post part according to prevailing conditions by varying the length of extension a through longitudinal displacement in the rod receivers 52, 53.

What is claimed is:

1. A therapy and exercise unit for restricted-guidance knee joint motion, the unit comprising:

a first lower leg receiver;

a second lower leg receiver;

a guiding arrangement, each of said first lower leg receiver and said second lower leg receiver being disposed on said guiding arrangement;

articulated devices;

a transmission element of the guiding arrangement, said first lower leg receiver and said second lower leg receiver being connected by said articulated devices to said transmission element, said transmission element connecting said first lower leg receiver and said second lower leg receiver to one another in a motionally coupled manner such that a swivelling motion of the one lower leg as a result of bending of the knee initiates an oppositely directed swivelling motion of the other lower leg; and a lever for connection of said first lower leg receiver and said second lower leg receiver to said articulated devices, said lever producing a restoring moment, which in terms of the direction of rotation counteracts a leg extension, about a pivot of the respective articulated device.

2. The therapy and exercise unit according to claim 1, wherein an effective length of said lever is variable.

3. The therapy and exercise unit according to claim 1, wherein said articulated devices are variable in terms of their arrangement relative to the transmission element.

4. The therapy and exercise unit according to claim 1, wherein said articulated devices are provided with a swivel radius limiting device.

5. The therapy and exercise unit according to claim 1, further comprising a snap in connection associated with each of said articulated devices, wherein said first and second lower leg receivers are releasably connected to said articulated devices by said snap-in connection.

6. The therapy and exercise unit according to claim 1, wherein said snap-in connection comprises a connecting pivot pin with a snap-in pin associated with the lower leg receiver and a swivel eye associated with the articulated device.

7. A therapy and exercise unit for restricted-guidance knee joint motion, the unit comprising:

a first lower leg receiver;

a second lower leg receiver;

a guiding arrangement, each of said first lower leg receiver and said second lower leg receiver being disposed on said guiding arrangement;

a first articulated device;

a second articulated device;

a transmission element of the guiding arrangement, said first lower leg receiver being connected by said first articulated device to said transmission element and said second lower leg receiver being connected by said second articulated device to said transmission element, said transmission element connecting said first lower leg receiver and said second lower leg receiver to one another in a motionally coupled manner such that a swivelling motion of the one lower leg as a result of bending of the knee initiates an oppositely directed swivelling motion of the other lower leg, said first articulated device and said second articulated device being disposed in such a way on said guiding arrangement that one of said first articulated device and said second articulated device, which via the associated lower leg receiver is associated with the flexed leg, is in a higher position than the other of said first articulated device and said second articulated device, which via the associated lower leg receiver is associated with the extended leg.

8. The therapy and exercise unit according to claim 7, wherein said guiding arrangement comprises an inclined guideway for the articulated devices.

9. The therapy and exercise unit according to claim 7, further comprising variable connection means for connecting each of said first articulated device and said second articulated device in a variable manner in terms of their arrangement relative to the transmission element.

10. The therapy and exercise unit according to claim 7, wherein each of said first articulated device and said second articulated device are provided with a swivel radius limiting device.

11. The therapy and exercise unit according to claim 7, further comprising a snap in connection associated with each of said said first articulated device and said second articulated device, wherein said first and second lower leg receivers are releasably connected to respective said first articulated device and said second articulated device by said snap-in connection.

12. The therapy and exercise unit according to claim 11, wherein said snap-in connection comprises a connecting pivot pin with a snap-in pin associated with the lower leg receiver and a swivel eye associated with the articulated device.

13. A therapy and exercise unit for restricted-guidance knee joint motion, the unit comprising:

a first lower leg receiver;

a second lower leg receiver;

a guiding arrangement, each of said first lower leg receiver and said second lower leg receiver being disposed on said guiding arrangement;

a first articulated device;

a second articulated device;

a transmission element of the guiding arrangement, said first lower leg receiver being connected by said first articulated device to said transmission element and said second lower leg receiver being connected by said second articulated device to said transmission element, said transmission element connecting said first lower leg receiver and said second lower leg receiver to one another in a motionally coupled manner such that a swivelling motion of the one lower leg as a result of bending of the knee initiates an oppositely directed swivelling motion of the other lower leg, said first lower leg receiver and said second lower leg receiver being disposed on respective said first articulated device and second articulated device in such a way that the axis of force of the extended leg is situated below a pivot of the articulated devices.

14. The therapy and exercise unit according to claim 13, further comprising variable connection means for connecting each of said first articulated device and said second articulated device in a variable manner in terms of their arrangement relative to the transmission element.

15. The therapy and exercise unit according to claim 13, wherein each of said first articulated device and said second articulated device are provided with a swivel radius limiting device.

16. The therapy and exercise unit according to claim 13, further comprising a snap in connection associated with each of said said first articulated device and said second articulated device, wherein said first and second lower leg receivers are releasably connected to respective said first articulated device and said second articulated device by said snap-in connection.

17. The therapy and exercise unit according to claim 16, wherein said snap-in connection comprises a connecting pivot pin with a snap-in pin associated with the lower leg receiver and a swivel eye associated with the articulated device.

* * * * *